US005862535A

United States Patent [19]

Noga et al.

[11] Patent Number: 5,862,535

[45] Date of Patent: Jan. 26, 1999

[54] DRAIN GUARD

[75] Inventors: Robert A. Noga, Del Mar; Raymond C. Matthias, Vista, both of Calif.

[73] Assignee: Noga Design, San Diego, Calif.

[21] Appl. No.: 940,559

[22] Filed: Sep. 30, 1997

[51] Int. Cl.[6] ..... A47K 1/14

[52] U.S. Cl. ..... 4/286; 4/292; 4/DIG. 18

[58] Field of Search ..... 4/286, 292, DIG. 18, 4/652, 654, 655, 657; 210/163, 164, 165, 166

[56] References Cited

U.S. PATENT DOCUMENTS 759,457 5/1904 Meloney ..... 4/652
950,571 3/1910 Morgan ..... 4/292
2,579,393 12/1951 Modrey ..... 4/654
4,351,073 9/1982 Elsas ..... 4/654

*Primary Examiner*—David J. Walczak

[57] ABSTRACT

A drain guard, for use in sinks having a drain, a bottom wall and a side wall, wherein the drain guard includes a screen for holding debris away from the sink drain. A seal, which abuts sealingly against the sink side wall, is disposed between the screen and the sink side wall to prevent debris from passing between the side wall and the screen, the seal and the screen being fixed in a frame which holds the screen a predetermined distance from the sink bottom. The frame includes a pair of arched bands which are useful as handles for moving the drain guard into, and out of the sink. In addition, the arched bands of a sink installed drain guard support heavy pots and other utensils away from the screen.

13 Claims, 1 Drawing Sheet

DRAIN GUARD

FIELD OF THE INVENTION

The present invention relates to sink drain guards. More particularly, the invention relates to a removable drain guard for preventing materials from entering a sink drain.

BACKGROUND ART

A common problem, experienced in restaurants and in other institutions, where large numbers of people are fed, is the handling of animal and vegetable wastes that are produced in the preparation of the food. Such wastes are varied in nature and may range in size from large vegetable substances, such as lettuce leaves, to very small substances as wet rice or tomato seeds. Clogged drains are often a result of a process that occurs in the sinks of restaurants, and other commercial establishments, where busy cooks dump substantial amounts of vegetable matter into the sinks.

In this regard, for example, in a typical hotel or restaurant, one or more pre-rinse sinks are utilized to prepare dishes for the table. Large amounts of leaves, husks, rinds and other debris are washed into these sinks as the dishes are prepared. Serious drain occlusions can occur unless these material are prevented from passing into the sink drain. Conventional screens are sometimes utilized in an attempt to keep these undesirable materials out of the sink drain, but these techniques are frequently unsatisfactory because surface tension across the screen openings effectively restricts water flow into the drain. As a result, because of their limitations, some conventional screening devices have little utility.

Thus, in the absence of effective drain protective techniques, large amounts of waste material accumulate and occlude commercial drain systems, often requiring regular and costly plumbing services to keep drains open. In addition, such accumulations can have public health consequences because of putrefaction occurring in drainage systems. In some cases, accumulated wastes cause drain system grease traps to overflow, ultimately degrading municipal water supplies.

In view of the foregoing, it is evident that a need exists for a device that could efficiently and effectively prevent waste material from entering sink drains. Desirably, such a device would be sturdy in construction and reliable and convenient to use.

DISCLOSURE OF INVENTION

It is an object of the present invention to provide a removable sink drain guard that is effective in preventing debris from entering a sink drain while allowing water flow in the drain.

It is another object of the present invention to provide a sink drain guard that is easily installed in, and removed from, a sink and is capable of screening out even very small objects.

It is a further object of the present invention to provide a sink drain guard that is sturdy in construction and reliable in performance.

It is a still further object of the present invention to provide a sink drain guard that is constructed of readily available materials.

Briefly, the above and further object of the present invention are realized by providing a drain guard, for use in sinks having a drain, a bottom wall and a side wall, wherein the drain guard includes a screen for holding debris away from the sink drain. A seal, which abuts sealingly against the sink side wall, is disposed between the screen and the sink side wall to prevent debris from passing between the side wall and the screen, the seal and the screen being fixed in a frame which holds the screen a predetermined distance from the sink bottom. The frame includes a pair of arched bands which are useful as handles for moving the drain guard into, and out of the sink. In addition, the arched bands of a sink installed drain guard support heavy pots and other utensils away from the screen.

The present invention affords several advantages. A distinct advantage is that the invention seals the entire sink surface to prevent debris from bypassing the screen and entering the drain. Further, since the screen is held at a predetermined distance from the sink bottom, water surface tension, as an impediment to drainage, is eliminated and uninterrupted water flow can be achieved. In addition, fine mesh screen cloth can be utilized as the screen to strain objects as small as wet rice and tomato seeds. Finally, the invention is sturdy in construction and fit for repeated and rough use in restaurant and other commercial kitchens.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MOST FOR CARRYING OUT THE INVENTION

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Figure 1:
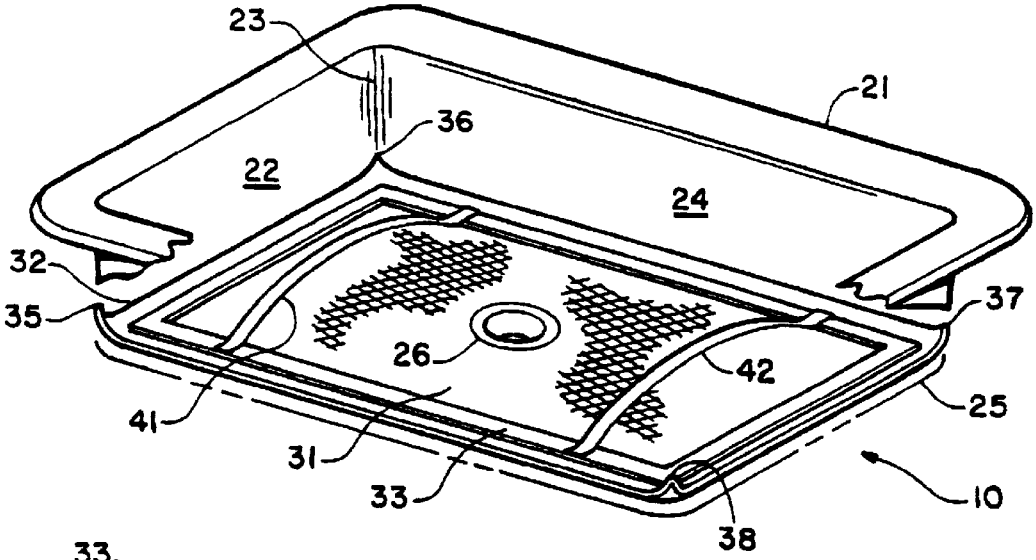
FIG. 1 is a perspective view of a typical installation of the drain guard showing a conventional sink partially cut away.

Referring now to the drawings, and particularly to FIG. 1 thereof, there is shown the drain guard 10 of the present invention, installed in a conventional sink 21. Portions of the sink 21 are shown as cut away to show details of construction of the guard 10. The sink 21 includes side walls 22 and 24, which meet at a curved junction 23, and a bottom wall 25 having a drain 26.

The drain guard 10 includes a screen 31 which is sandwiched between an upper frame 33 and a lower frame 34. A flexible, flat elastomeric seal 32, longer and wider than the upper frame 33, is fixed between the screen 31 and the lower frame 34. The dimensions of the drain guard 10, and especially of the seal 32, are sized as to be compatible with the inner dimensions of conventional sinks. Thus, while a drain guard 10 for a generally rectangular sink is described herein, it will be apparent to one skilled in the art that drain guards for round, oval or other-shaped sinks are within the scope of the present invention.

When the drain guard 10 is installed in the sink 21, sealing lips 35–38 form where the sink side walls meet as, for example, lip 36 forms at the junction 23. In this manner, the seal 32 presents a virtually continuous line of engagement with the sink side walls, thereby preventing wastes from bypassing the drain guard 10 and entering the drain 26.

With reference now to FIGS. 2–5, some of the novel aspects of the drain guard 10 may be seen. The screen 31 is preferably comprised of 0.033 inch diameter stainless steel wire cloth having about 5 to 15 holes per linear length, 10 holes being preferred. The seal 32 is preferably about ¼ inch in thickness and is composed of a flexible, elastomeric material such as neoprene. In a preferred embodiment, the upper frame 33 and the lower frame 34 are metal, such as aluminum, with stainless steel preferred.

Figure 5:
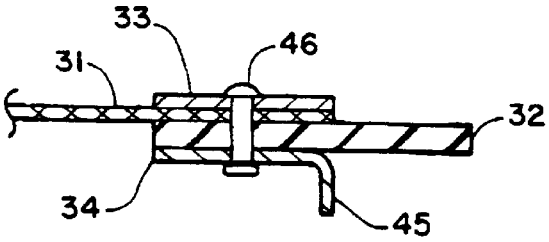
FIG. 5 is a sectional view of the drain guard of the present invention, taken in a plane indicated by lines 5—5 of FIG. 2.

As seen best in FIG. 5, the lower frame 34 includes a spacer 45 which, in use, rests against the sink bottom wall 25 and serves to hold the drain guard 10 at a distance from the bottom wall, thereby preventing water tension from developing across the screen 31 to impede water flow through the screen and into the drain 26. In a preferred embodiment, the lower frame 34 is of angled stock stainless steel having the spacer 45 integrally incorporated therewith. The spacer 45 can range in height from ¼ inch to about ½ inch with a preferred height of about ⅜ inch.

Figure 2:
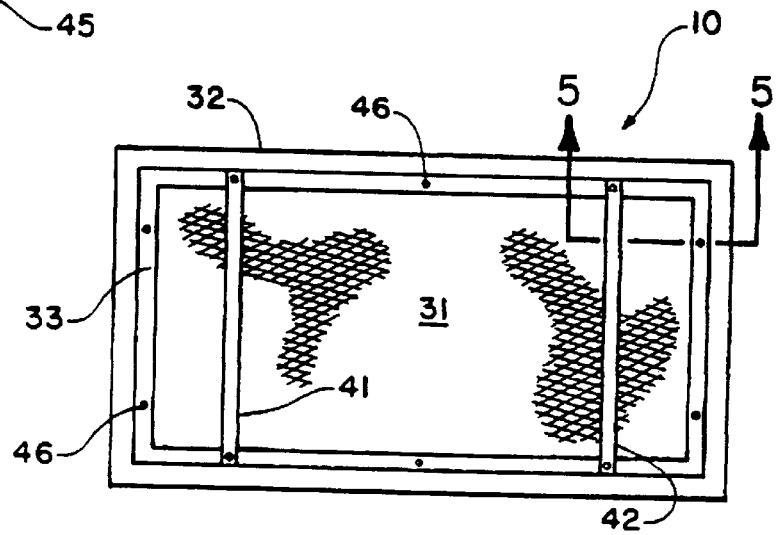
FIG. 2 is a plan view of the drain guard present invention.
Figure 4:
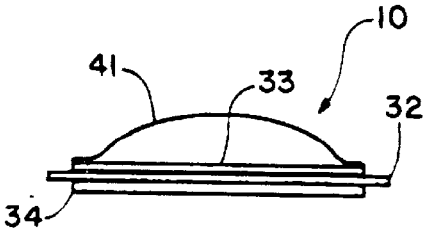
FIG. 4 is an elevetional view of the drain guard of the present invention.
Figure 3:
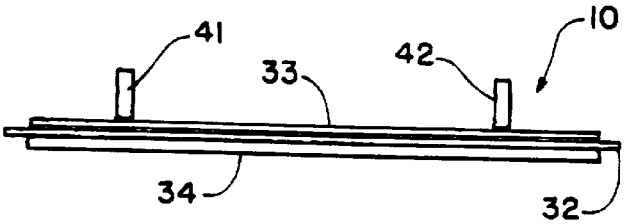
FIG. 3 is an elevational view of the drain guard of the present invention.

With reference now to FIGS. 2 and 5, the drain guard 10 is comprised of the upper frame 33, the screen 31, seal 32 and lower frame 34, held together in a conventional manner by fasteners or bolts 46.

In use, the drain guard 10 is placed into the sink 21 until the spacer 45 contacts the sink bottom wall 25. The drain guard can be conveniently manipulated by means of arched bands 41 and 42, each of which is attached at two opposite points on the upper frame 33. The bands are preferably of stainless steel construction. In addition to providing convenient handles for the drain guard 10, the arched bands 41 and 42 also strengthen the drain guard 10 and help in retaining its shape. Further, during a typical day in a commercial kitchen, large amounts of debris are forcefully dumped from heavy kettles and pots, into the sink. At these times, the arched bands 41 and 42 serve to hold the kettles and pots away from the screen 31, thereby preventing damage to the screen.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. A drain guard for preventing entrance of unwanted materials into a sink drain, the sink having a drain, a bottom wall and side walls, the drain guard comprising:

screen means for holding substances away from the sink drain;

means fixed to said screen means and extending therefrom for sealing engagement with said sink side walls for preventing passage of unwanted materials into said drain;

means for holding said screen means a predetermined distance away from the sink bottom wall; and an upper frame and a lower frame wherein said screen means and said sealing means are fixed between said upper frame and said lower frame.

2. A drain guard according to claim 1, wherein said screen means is a wire cloth having about ten holes per linear inch.

3. A drain guard according to claim 1 wherein said screen means is constructed of stainless steel.

4. A drain guard according to claim 1 wherein said sealing means is an elastomeric composition.

5. A drain guard according to claim 1 wherein said sealing means is a neoprene composition.

6. A drain guard according to claim 1 wherein said means for holding said screen means a predetermined distance away from a sink bottom wall is a spacer integrally connected to said lower frame.

7. A drain guard according to claim 1 wherein said predetermined distance is about ¼ inch to about ½ inch.

8. A drain guard according to claim 1 wherein said predetermined distance is about ⅜ inch.

9. A drain guard according to claim 1 wherein said upper frame and said lower frame is each composed of stainless steel.

10. A drain guard according to claim 1 wherein said upper frame and said lower frame is each composed of aluminum.

11. A drain guard according to claim 1 wherein said upper frame includes means for holding objects away from said screen.

12. A drain guard according to claim 11 wherein said means for holding includes a band, said band being fixed at two points to said upper frame.

13. A drain guard according to claim 11 wherein said means for holding includes a plurality of bands.

* * * * *